US007581978B1

(12) United States Patent
Briant

(10) Patent No.: US 7,581,978 B1
(45) Date of Patent: Sep. 1, 2009

(54) CONNECTOR ASSEMBLY WITH A LATCH

(75) Inventor: Eric David Briant, Dillsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/187,076

(22) Filed: Aug. 6, 2008

(51) Int. Cl.
*H01R 13/62* (2006.01)

(52) U.S. Cl. ..... 439/358

(58) Field of Classification Search ..... 439/357, 439/358, 352, 350, 356, 355; 24/DIG. 52, 24/581.1, 615
See application file for complete search history.

(56) References Cited

U.S. PATENT DOCUMENTS

| | | | | |
|---|---|---|---|---|
| 5,295,855 | A * | 3/1994 | Walz | 439/354 |
| 5,749,746 | A * | 5/1998 | Tan et al. | 439/357 |
| 5,797,771 | A * | 8/1998 | Garside | 439/610 |
| 6,056,578 | A * | 5/2000 | Lin | 439/358 |
| 6,099,339 | A * | 8/2000 | Yanagida et al. | 439/358 |
| 6,186,819 | B1 * | 2/2001 | Holub | 439/358 |
| 6,234,828 | B1 * | 5/2001 | Kuo | 439/358 |
| 6,312,277 | B1 * | 11/2001 | Holub | 439/352 |
| 6,398,577 | B1 * | 6/2002 | Simmel et al. | 439/357 |
| 6,431,887 | B1 * | 8/2002 | Yeomans et al. | 439/108 |
| 6,572,400 | B2 * | 6/2003 | Noguchi et al. | 439/489 |
| 6,585,536 | B1 * | 7/2003 | Wu | 439/358 |
| 6,585,537 | B1 * | 7/2003 | Lee | 439/358 |
| 6,655,979 | B1 * | 12/2003 | Lee | 439/357 |
| 6,736,663 | B2 * | 5/2004 | Lee et al. | 439/358 |
| 7,083,459 | B1 * | 8/2006 | Wu et al. | 439/354 |
| 7,204,002 | B2 * | 4/2007 | Kaneko et al. | 24/614 |
| 7,281,937 | B2 | 10/2007 | Reed et al. | |
| 7,318,740 | B1 | 1/2008 | Henry et al. | |
| 7,329,154 | B2 * | 2/2008 | Koyama | 439/660 |
| 7,354,292 | B1 * | 4/2008 | Lloyd et al. | 439/352 |
| 2002/0111060 | A1 * | 8/2002 | Challis et al. | 439/352 |
| 2005/0064756 | A1 * | 3/2005 | Hsiao et al. | 439/357 |
| 2006/0148300 | A1 * | 7/2006 | Huang et al. | 439/353 |

* cited by examiner

*Primary Examiner*—T C Patel
*Assistant Examiner*—Harshad C Patel

(57) ABSTRACT

A connector assembly is configured to latch and unlatch with a mating connector. The mating connector includes a latch cavity. The connector assembly includes a housing and a latch. The housing includes front and rear towers. The latch is coupled to the housing and is supported by the front and rear towers. The latch includes a latch end and a floating portion. The latch end is configured to be inserted into the latch cavity to latch with the mating connector and be removed from the latch cavity to unlatch with the mating connector. The floating portion is disposed between the front and rear towers. The floating portion is configured to be biased towards the housing by a load applied to the floating portion to raise the latch end out from the latch cavity. The load is applied in a direction towards the housing and between the front and rear towers.

20 Claims, 5 Drawing Sheets

CONNECTOR ASSEMBLY WITH A LATCH

BACKGROUND OF THE INVENTION

The subject matter herein generally relates to connector assemblies and, more particularly, to a connector assembly that latches and unlatches with a mating connector.

Various types of connectors include latches to secure the connector with a mating connector. The connectors mate by loading one connector into the other along a loading direction. The latch of one connector is lowered to engage the mating connector and thus latch and secure the two connectors together. The connectors may be separated by unlatching the latch from the mating connector. Some known connectors are configured to latch and unlatch with the mating connector by raising the latch of the connector away from the mating connector. The latch may be raised by applying a load to the latch to depress a part of the latch downwards towards the connector. Known connectors with latches, however, are not without disadvantages. For instance, known connector latches are easily plastically deformed through repeated use of the latch and repeated depression of the latch downwards towards the connector. For example, the latches may not return to the original position or shape of the latch after the load is removed from the latch. As the latches become plastically deformed, the latches do not secure the connectors together as well as the latches did prior to being plastically deformed. Other known connectors have relatively complex latches that may be expensive and time-consuming to manufacture.

Thus, a need exists for connector having a latch that is robust and relatively inexpensive to manufacture. For example, a need exists for a latch that does not plastically deform when depressed to unlatch the connector with a mating connector.

BRIEF DESCRIPTION OF THE INVENTION

In one embodiment, a connector assembly is configured to latch and unlatch with a mating connector. The mating connector includes a latch cavity. The connector assembly includes a housing and a latch. The housing includes a front tower and a rear tower. The latch is coupled to the housing and is supported by the front and rear towers. The latch includes a latch end and a floating portion. The latch end is movable between a latched position and an unlatched position with the latch end inserted into the latch cavity of the mating connector in the latched position and removed from the latch cavity in the unlatched position. The floating portion is disposed between the front and rear towers. The floating portion is biased towards the housing by a load applied to the floating portion to move the latch end to the unlatched position. The load is applied in a direction towards the housing and between the front and rear towers.

In another embodiment, a connector assembly is configured to latch and unlatch with a mating connector. The mating connector includes a latch cavity. The connector assembly includes a housing and a latch. The housing includes a front tower and a rear tower. The latch is coupled to the housing and is supported by the front and rear towers. The latch includes a latch end and a floating portion. The latch end is configured to be inserted into the latch cavity to latch with the mating connector and be removed from the latch cavity to unlatch with the mating connector. The floating portion is disposed between the front and rear towers. The floating portion is configured to be deformed towards the housing to raise the latch end out from the latch cavity when a load is applied to the floating portion. The front and rear towers are spaced apart such that the floating portion is elastically deformed when the load is applied.

In another embodiment, a connector assembly is configured to latch and unlatch with a mating connector. The mating connector includes a latch cavity. The connector assembly includes a housing and a latch. The housing includes a front tower and a rear tower. The latch is coupled to the housing and is supported by the front and rear towers. The latch includes a latch end and a floating portion. The latch end is configured to be inserted into the latch cavity to latch with the mating connector and be removed from the latch cavity to unlatch with the mating connector. The floating portion is disposed between the front and rear towers. The front tower extends above the housing by a tower height. The tower height is sufficiently small such that a load applied to the floating portion towards the housing and between the front and rear towers elastically deforms the latch in order to raise the latch end out from the latch cavity.

DETAILED DESCRIPTION OF THE INVENTION

Figure 1:
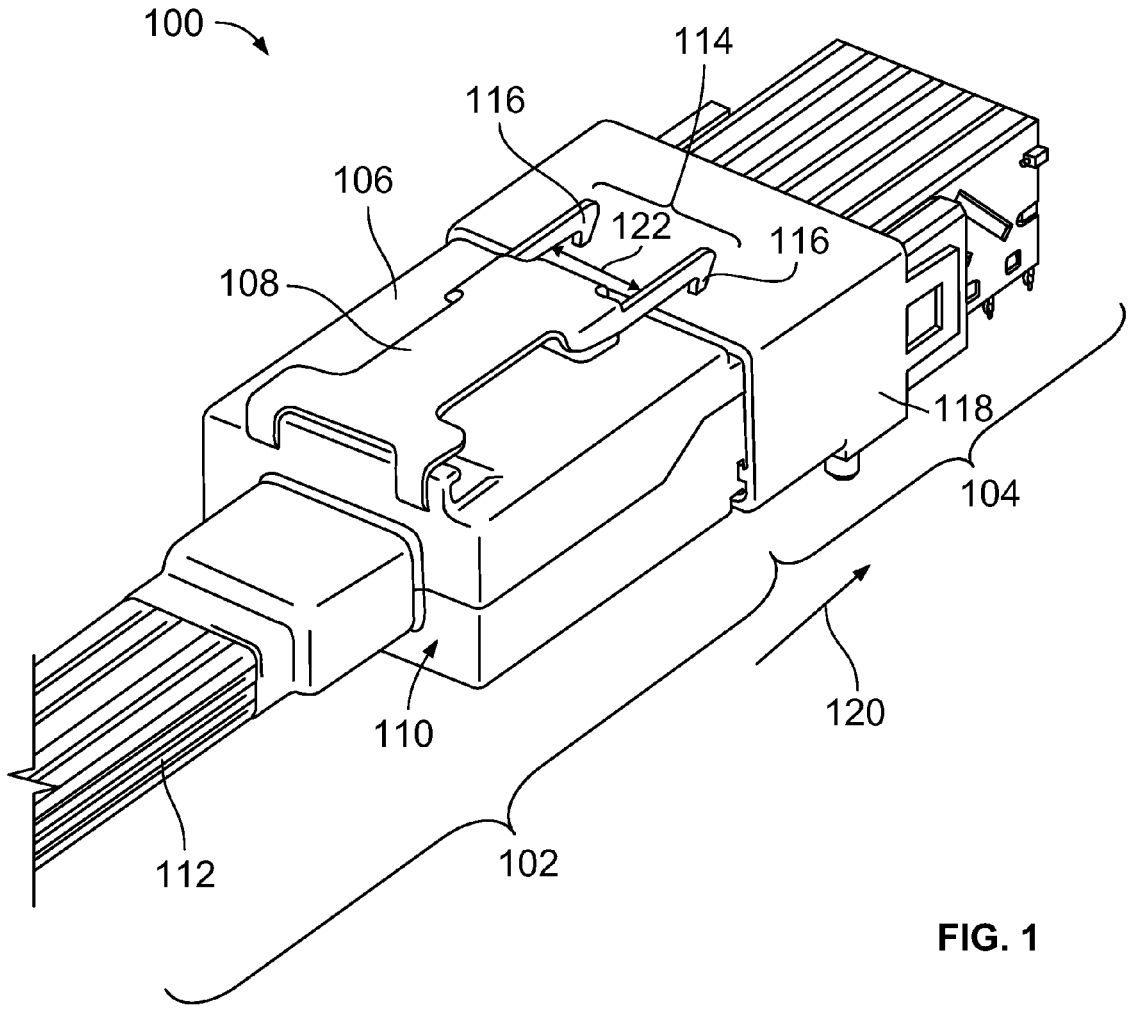
FIG. 1 is a perspective view of a connector system according to one embodiment.

FIG. 1 is a perspective view of a connector system 100 according to one embodiment. The connector system 100 includes a connector assembly 102 that mates with a mating connector 104. In the illustrated embodiment, the connector assembly 102 is partially loaded into the mating connector 104 to electrically connect the connector assembly 102 with the mating connector 104. The connector assembly 102 may be loaded into the mating connector 104 along a loading direction 120.

The connector assembly 102 includes a housing 106 and a latch 108. In one embodiment, the housing 106 includes, or is formed from, a dielectric material such as a plastic material. In another embodiment, the housing 106 includes, or is formed from, a conductive material such as a metal material. The housing 106 extends between a cable end 110 and a mating end 310 (shown in FIG. 3). The cable end 110 receives one or more cables 112. The cables 112 include one or more conductors (not shown) that extend through the housing 106 to a mating interface 312 (shown in FIG. 3) at the mating end 310. The conductors are electrically connected to contacts (not shown) disposed at the mating interface 312. The contacts engage corresponding contacts (not shown) in the mating connector 104 to provide the electrical connection between the connector assembly 102 and the mating connector 104.

The latch 108 is coupled to the housing 106 and latches with the mating connector 104 to secure the connector assembly 102 and mating connector 104 together. For example, the latch 108 may prevent the connector assembly 102 from being separated from the mating connector 104 along a direction that is substantially opposite to the loading direction 120.

In the illustrated embodiment, a latch end 114 of the latch 108 includes a plurality of hook elements 116. The hook elements 116 are inserted or lowered into one or more latch cavities 402 (shown in FIG. 4) in the mating connector 104 to latch the latch end 114 and the connector assembly 102 with the mating connector 104. During use, the latch end 114 may be raised so that the hook elements 116 are removed from the latch cavities 402 and the latch 108 and connector assembly 102 may be unlatched from the mating connector 104. In the illustrated embodiment, the hook elements 116 are separated by a gap 122 at the latch end 114.

The mating connector 104 includes a housing 118 that is shaped to receive the mating end (not shown) of the connector assembly 102. The mating connector 104 may be mounted to a circuit board 400 (shown in FIG. 4) or other device and electrically connected to the board or device. Mating the connector assembly 102 with the mating connector 104 may then provide for communication between the connector assembly 102 and the circuit board 400 or device.

Figure 2:
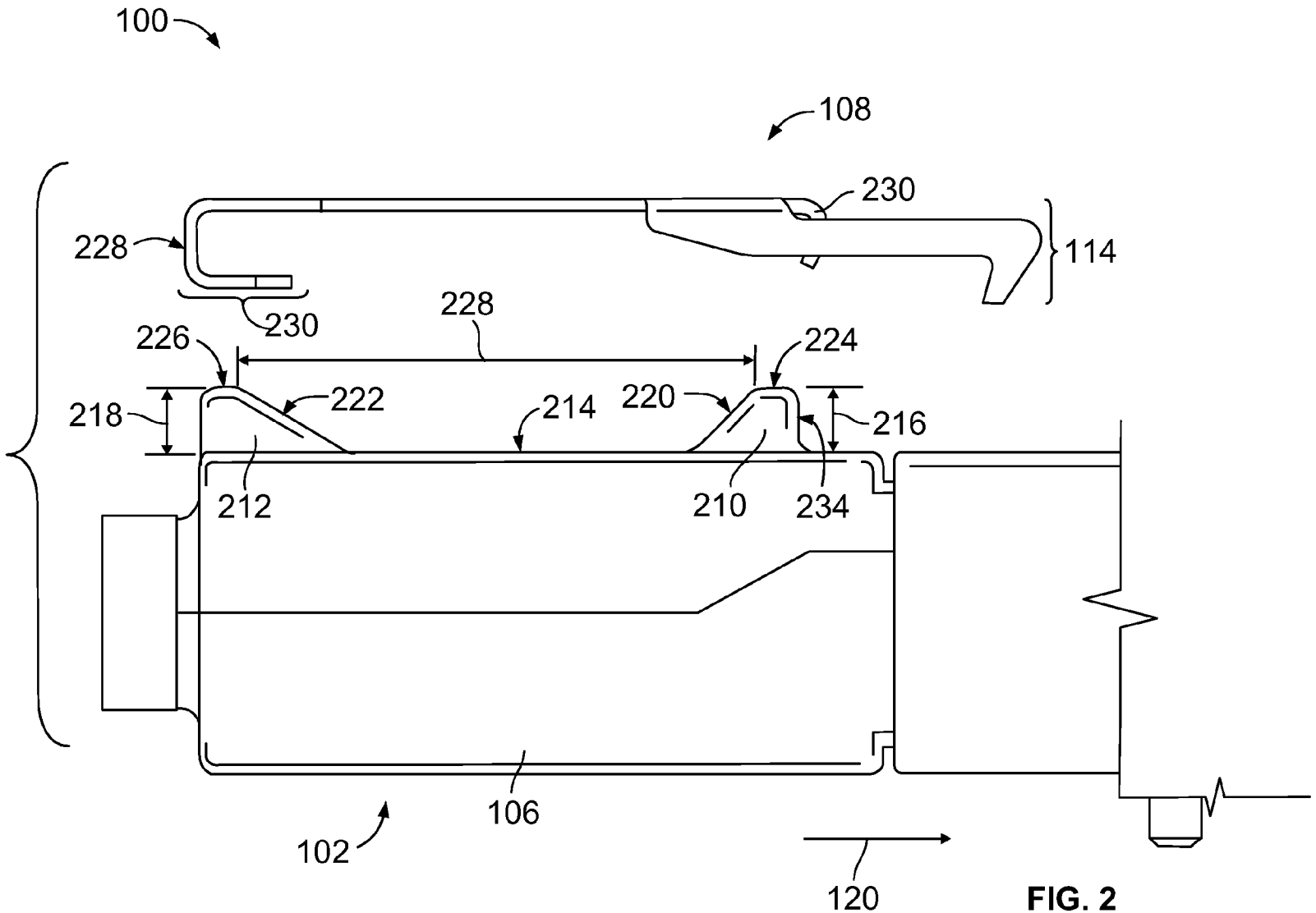
FIG. 2 is an exploded view of the connector system 100 shown in FIG. 1.

FIG. 2 is an exploded view of the connector system 100. The housing 106 of the connector assembly 102 includes front and rear towers 210, 212 that extend away from an upper surface 214 of the housing 106. The front tower 210 extends a front tower height 216 upwards from the upper surface 214 and the rear tower 212 extends a rear tower height 218 upwards from the upper surface 214. In one embodiment, the front and rear tower heights 216, 218 are approximately the same. In another embodiment, the front and rear tower heights 216, 218 differ from one another. In the illustrated embodiment, the front and rear towers 210, 212 include oppositely sloped surfaces 220, 222. In another embodiment, one or both of the front and rear towers 210, 212 do not include the sloped surfaces 220, 222. Also as shown in the illustrated embodiment, each of the front and rear towers 210, 212 includes a support surface 224, 226. The support surfaces 224, 226 support the latch 108 above the housing 106. The front and rear towers 210, 212 are spaced apart from one another by a tower separation distance 228. In one embodiment, the tower separation distance 228 is the distance between the support surfaces 224, 226 along a direction that is substantially parallel to the loading direction 120. The tower separation distance 228 may be approximately 20 millimeters, for example. In one embodiment, the tower separation distance 228 is approximately 19.31 millimeters.

The latch 108 extends between a back end 228 and the latch end 114. In the illustrated embodiment, the back end 228 includes a latch finger 230. The latch finger 230 may be a feature, extension, protrusion, finger, and the like, that couples the latch 108 to the housing 106. In the illustrated embodiment, the latch finger 230 is a bent portion of the latch 108 that is inserted into the rear tower 212 to couple the latch 108 to the housing 106 and to prevent the movement of the latch 108 along the loading direction 120 relative to the housing 106.

Figure 3:
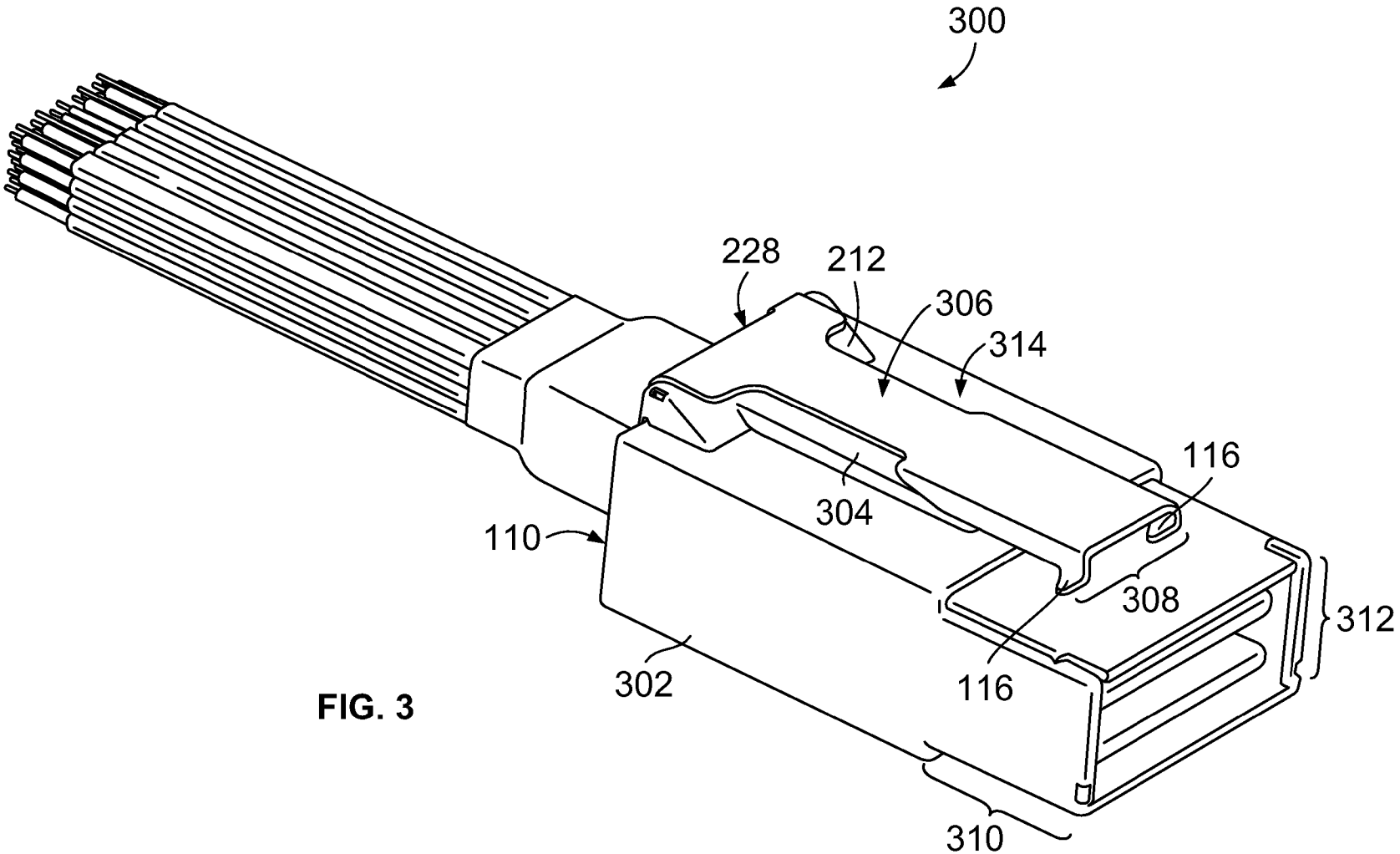
FIG. 3 is a perspective view of a connector assembly according an alternative embodiment.

FIG. 3 is a perspective view of a connector assembly 300 according an alternative embodiment. The connector assembly 300 includes a housing 302 that may be similar to the housing 106 (shown in FIG. 1). The housing 302 extends between the cable end 110 and the mating end 310. The mating end 310 is received in the housing 118 (shown in FIG. 1) of the mating connector 104 (shown in FIG. 1). The mating end 310 includes the mating interface 312 that is configured to mate with the mating connector 104. In the illustrated embodiment, the housing 302 includes a protrusion 304 that extends upwards from an upper surface 314 of the housing 302. The protrusion 304 may be a raised strip of the housing 302 that extends between the front and rear towers 210, 212. The protrusion 304 may limit the vertical travel of the latch 306 when a load L is applied to the latch 306, as described below. A latch 306 may be similar to the latch 108 and is coupled to the housing 302. The latch 306 extends between the back end 228 and a latch end 308. The latch end 308 may be similar to the latch end 114 and may include a plurality of hook elements 116. In contrast to the latch end 114 of the latch 108 shown in FIG. 1, the hook elements 116 of the latch 306 are not separated by the gap 122.

Figure 4:
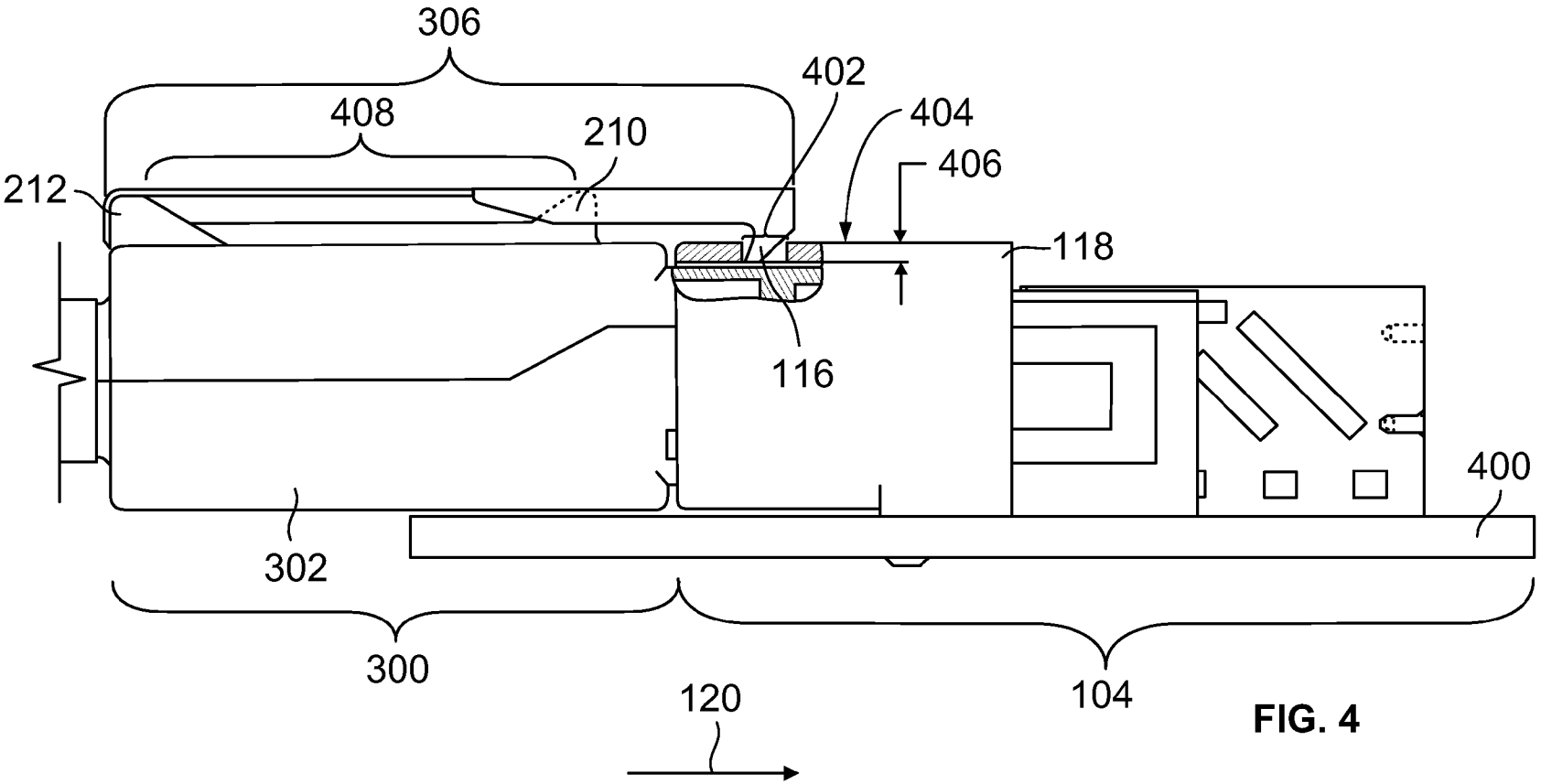
FIG. 4 is a partial cut away view of the connector assembly shown in FIG. 3 in a latched position and mated with the mating connector shown in FIG. 1.

FIG. 4 is a partial cut away view of the connector assembly 300 in a latched position and mated with the mating connector 104. As shown in FIG. 4, the mating connector 104 may be mounted to the circuit board 400. As shown in the partial cut away portion of the mating connector 104, the latch cavities 402 extend into the housing 118 of the mating connector 104 from a top surface 404 of the housing 118. The latch cavities 402 receive the hook elements 116 of the latch 306 to secure the connector assembly 302 and mating connector 104 together. The hook elements 116 may extend into the latch cavities 402 by a depth 406. The depth 406 is sufficiently deep into the latch cavities 402 such that the connector assembly 300 cannot be unloaded from the mating connector 104 along a direction opposite the loading direction 120 without first raising the hook elements 116 out of the latch cavities 402. In one embodiment, the depth 406 is approximately 1 millimeter. For example, the depth 406 may be approximately 0.88 millimeters. The front and rear towers 210, 212 support the latch 306 above the housing 302. A floating portion 408 of the latch 306 extends between the front and rear towers 210, 212. In one embodiment, the floating portion 408 is the portion of the latch 306 between the front and rear towers 210, 212 that is elevated above the upper surface 314 (shown in FIG. 3) and does not directly contact the housing 302.

Figure 5:
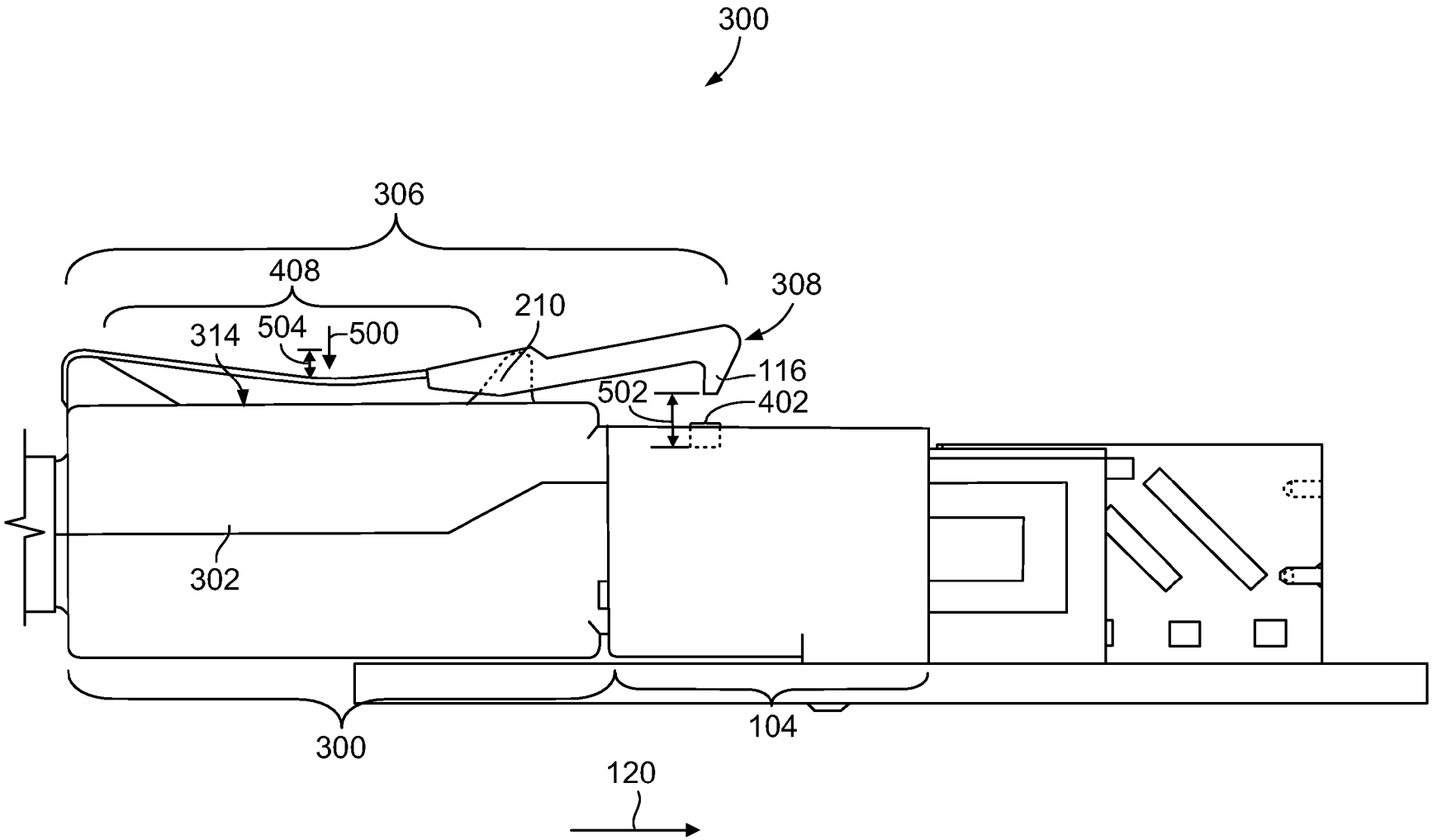
FIG. 5 is an elevational view of the connector assembly shown in FIG. 3 in an unlatched position.

FIG. 5 is an elevational view of the connector assembly 300 in an unlatched position. The connector assembly 300 and the latch 306 may be unlatched from the mating connector 104 so that the connector assembly 300 may be removed from the connector assembly 300 by applying a load L to the latch 306. For example, a load L may be applied on the floating portion 408 of the latch 306. The load L may be applied towards the housing 302 between the front and rear towers 210, 212. The load L may be applied in a direction 500 that is substantially perpendicular to the upper surface 314 of the housing 302. In another embodiment, the load L may be applied in a direction that is transverse to the upper surface 314. As the load L is applied to the floating portion 408, the floating portion 408 is biased towards the housing 302. For example, at least part of the floating portion 408 may travel a depression distance 504 towards the housing 302 in response to the load L being applied to the floating portion 408. The depression distance 504 is in a substantially vertical direction in one embodiment. For example, the depression distance 504 may be measured in a direction that is substantially perpendicular to the upper surface 314. The total distance that the floating portion 408 may vertically travel when the load L is applied may be limited by the housing protrusion 304 (shown in FIG. 3) in one embodiment. For example, the housing protrusion 304 may extend sufficiently far from the upper surface 314 so as to prevent the latch 306 from being plastically deformed when the load L is applied. In one embodiment, the housing protrusion 304 extends away from the upper surface 314 such that the housing protrusion 304 and the latch 306 are separated by approximately 1 millimeter. For example, the housing protrusion 304 and the latch 306 may be separated by approximately 1.2 millimeters.

In one embodiment, the front tower 210 acts as a fulcrum about which the latch 306 pivots to raise the latch end 308 when the load L is applied to the floating portion 408. Based on one or more factors, the hook elements 116 may be removed from the latch cavities 402. For example, the hook elements 116 may be completely raised out of the latch cavities 402 by raising the hook elements 116 by a height 502 that is at least as great as the depth 406 (shown in FIG. 4) at which the hook elements 116 were inserted into the latch cavities 402. By way of example only, these factors may include the amount of the load L, the direction 500 at which the load L is applied on the floating portion 408, the location at which the load L is applied on the floating portion 408, the tower separation distance 228 (shown in FIG. 2), the front tower height 216 (shown in FIG. 2), the rear tower height 218 (shown in FIG. 2), the dimensions of the latch 306, the material(s) included in the latch 306, and the like. Once the hook elements 116 are raised out from the latch cavities 402, the connector assembly 300 may be removed from the mating connector 104 by unloading the connector assembly 300 in a direction that is opposite the loading direction 120. The load L may be removed from the floating portion 408 to lower the latch end 308 and the hook elements 116. For example, by removing the load L from the floating portion 408, the latch 306 may substantially return to the original position of the latch 306 shown in FIG. 3.

In one embodiment, the latch 306 includes, or is formed from, a material that is elastically deformed when the load L is applied to the floating portion 408 to avoid plastic, or inelastic, deformation. For example, the latch 306 may include a material that allows the latch 306 to be elastically deformed when the load L is applied to the floating portion 408 and substantially return to the original shape of the latch 306 once the load L is removed from the floating portion 408. In one embodiment, the latch 306 includes or is formed from a stainless steel. For example, the latch 306 may be formed from stainless steel defined by the standard UNS S30100.

In one embodiment, the tower separation distance 228 (shown in FIG. 2) is sufficiently large such that the latch 306 does not plastically deform when the load L is applied to the floating section 408. For example, the tower separation distance 228 may be larger than a minimum separation distance. The minimum separation distance may be the smallest distance between the front and rear towers 210, 212 that is used to raise the hook elements 116 out of the latch cavities 402 when the load L is applied to the floating portion 408 while not plastically deforming the latch 306. For example, if the tower separation distance 228 is less than this minimum separation distance, then the hook elements 116 may be plastically deformed when the load L is applied to raise the hook elements 116 out of the latch cavities 402. In another example, if the tower separation distance 228 is greater than the minimum separation distance, then the latch 306 is not plastically deformed when the load L is applied to raise the hook elements 116 out of the latch cavities 402. Alternatively, the tower separation distance 228 may be greater than a threshold that is greater than the minimum separation distance. For example, in order to avoid plastically deforming the latch 306, the tower separation distance 228 may be kept above a fraction or percentage of the minimum separation distance. In one example, the tower separation distance 228 may be 110% of the minimum separation distance. In another example, the tower separation distance 228 may be 120% of the minimum separation distance. In another example, the tower separation distance 228 may be 130% of the minimum separation distance. The minimum separation distance may be a function of a variety of factors. By way of example only, the minimum separation distance may be a function of the amount of the load L necessary to raise the hook elements 116 out from the latch cavities 402, the direction 500 at which the load L is applied on the floating portion 408, the location at which the load L is applied on the floating portion 408, the front tower height 216 (shown in FIG. 2), the rear tower height 218 (shown in FIG. 2), the dimensions of the latch 306, the material(s) included in the latch 306, and the like.

In one embodiment, the tower separation distance 228 (shown in FIG. 2) is sufficiently small such that the hook elements 114 are raised out from the latch cavities 402 when the load L is applied to the floating section 408 without plastically deforming the latch 306. For example, the tower separation distance 228 may be smaller than a maximum separation distance. The maximum separation distance may be the greatest distance between the front and rear towers 210, 212 that is used to raise the hook elements 116 out of the latch cavities 402 when the load L is applied to the floating portion 408 while not plastically deforming the latch 306. For example, if the tower separation distance 228 is greater than this maximum separation distance, then the hook elements 116 may not be raised out from the latch cavities 402 when the load L is applied. In another example, if the tower separation distance 228 is smaller than the maximum separation distance, then the hook elements 116 may be raised out from the latch cavities 402 when the load L is applied. The maximum separation distance may be a function of a variety of factors. By way of example only, the maximum separation distance may be a function of the amount of the load L necessary to raise the hook elements 116 out from the latch cavities 402, the direction 500 at which the load L is applied on the floating portion 408, the location at which the load L is applied on the floating portion 408, the front tower height 216 (shown in FIG. 2), the rear tower height 218 (shown in FIG. 2), the dimensions of the latch 306, the material(s) included in the latch 306, and the like.

In one embodiment, one or both of the front and rear tower heights 216, 218 (shown in FIG. 2) is sufficiently small such that the latch 306 does not plastically deform when the load L is applied to the floating section 408. For example, one or both of the front and rear tower heights 216, 218 may be smaller than a maximum tower height. The maximum tower height may be the greatest height of one or both of the front and rear towers 210, 212 that is used to raise the hook elements 116 out of the latch cavities 402 when the load L is applied to the floating portion 408 while not plastically deforming the latch 306. For example, if one or both of the front and rear tower heights 216, 218 is greater than this maximum tower height, then the hook elements 116 may not be raised out from the latch cavities 402 when the load L is applied. In another example, if one or both of the front and rear tower heights 216, 218 is greater than the maximum tower height, then the latch 306 is plastically deformed when the load L is applied to raise the hook elements 116 out of the latch cavities 402. Alternatively, one or both of the front and rear tower heights 216, 218 may be less than a threshold that is less than the maximum tower height. For example, in order to avoid plastically deforming the latch 306, one or both of the front and rear tower heights 216, 218 may be kept below a fraction or percentage of the maximum tower height. In one example, one or both of the front and rear tower heights 216, 218 may be 90% of the maximum tower height. In another example, one or both of the front and rear tower heights 216, 218 may be 80% of the maximum tower height. In another example, one or both of the front and rear tower heights 216, 218 may be 70% of the maximum tower height. The maximum tower height may be a function of a variety of factors. By way of example only, the maximum tower height may be a function of the amount of the load L necessary to raise the hook elements 116 out from the latch cavities 402, the direction 500 at which the load L is applied on the floating portion 408, the location at which the load L is applied on the floating portion 408, the tower separation distance 228 (shown in FIG. 2), the dimensions of the latch 306, the material(s) included in the latch 306, and the like.

In one embodiment, one or both of the front and rear tower heights 216, 218 (shown in FIG. 2) is sufficiently large such that the hook elements 114 are raised out from the latch cavities 402 when the load L is applied to the floating section 408 without inelastically deforming the latch 306. For example, one or both of the front and rear tower heights 216, 218 may be greater than a minimum tower height. The minimum tower height may be the smallest height of one or both of the front and rear towers 210, 212 that is used to raise the hook elements 116 out of the latch cavities 402 when the load L is applied to the floating portion 408 while not inelastically deforming the latch 306. For example, if one or both of the front and rear tower heights 216, 218 is smaller than this minimum tower height, then the hook elements 116 may not be raised out from the latch cavities 402 when the load L is applied. In another example, if one or both of the front and rear tower heights 216, 218 is smaller than the minimum tower height, then the latch 306 is plastically deformed when the load L is applied to raise the hook elements 116 out of the latch cavities 402. The minimum tower height may be a function of a variety of factors. By way of example only, the minimum tower height may be a function of the amount of the load L necessary to raise the hook elements 116 out from the latch cavities 402, the direction 500 at which the load L is applied on the floating portion 408, the location at which the load L is applied on the floating portion 408, the tower separation distance 228 (shown in FIG. 2), the dimensions of the latch 306, the material(s) included in the latch 306, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly configured to latch and unlatch with a mating connector having a latch cavity, the connector assembly comprising:

a housing comprising a front tower and a rear tower; and a latch coupled to the housing and supported by the front and rear towers, the latch comprising a latch end and a floating portion, the latch end being movable between a latched position and an unlatched position with the latch end inserted into the latch cavity of a mating connector in the latched position and removed from the latch cavity in the unlatched position, the floating portion disposed between the front and rear towers, wherein the floating portion is biased toward the housing to engage the front tower by a load applied to the floating portion to move the latch end to the unlatched position, the load applied in a direction toward the housing and between the front and rear towers.

2. The connector assembly of claim 1, wherein the front and rear towers are spaced apart by a tower separation distance, the tower separation distance being sufficiently large such that the latch elastically deforms when the load is applied to raise the latch end out from the latch cavity.

3. The connector assembly of claim 1, wherein the front and rear towers are spaced apart by a tower separation distance, the tower separation distance being sufficiently small such that the latch end is completely removed from the latch cavity when the load is applied to the floating portion.

4. The connector assembly of claim 1, wherein the front tower provides a fulcrum about which the latch pivots when the load is applied to the floating portion, the front tower extending from the housing by a tower height that is sufficiently small such that the latch does not inelastically deform when the load is applied to raise the latch end out from the latch cavity.

5. The connector assembly of claim 1, wherein the front tower provides a fulcrum about which the latch pivots when the load is applied to the floating portion, the front tower extending from the housing by a front tower height that is sufficiently large such that the latch end is completely removed from the latch cavity when the floating portion is biased toward the housing.

6. The connector assembly of claim 1, wherein a vertical travel of the floating portion is limited by a housing protrusion disposed between the front and rear towers, the housing protrusion extending away from the housing toward the floating portion.

7. The connector assembly of claim 1, wherein the latch comprises a front latch finger that engages the front tower to prevent the latch from moving toward the rear tower.

8. A connector assembly configured to latch and unlatch with a mating connector having a latch cavity, the connector assembly comprising:

a housing comprising a front tower and a rear tower; and a latch coupled to the housing and supported by the front and rear towers, the latch comprising a latch end and a floating portion, the latch end configured to be inserted into the latch cavity to latch with the mating connector and removed from the latch cavity to unlatch with the mating connector, the floating portion disposed between the front and rear towers, wherein the floating portion is configured to be deformed toward the housing to raise the latch end out from the latch cavity when a load is applied to the floating portion and the latch engages the front tower, the front and rear towers being spaced apart such that the floating portion is elastically deformed when the load is applied.

9. The connector assembly of claim 8, wherein the front and rear towers are spaced apart by a tower separation distance, the tower separation distance being sufficiently small such that the latch end is completely removed from the latch cavity when the load is applied to the floating portion.

10. The connector assembly of claim 8, wherein the front tower provides a fulcrum about which the latch pivots when the floating portion is biased toward the housing to raise the latch end.

11. The connector assembly of claim 8, wherein the front tower extends from the housing by a tower height, the tower height being sufficiently large such that the latch end is completely removed from the latch cavity when the load is applied to the floating portion.

12. The connector assembly of claim 8, wherein the front tower extends from the housing by a tower height, the tower height being sufficiently small such that the latch is elastically deformed when the load is applied to the floating portion.

13. The connector assembly of claim 8, wherein a vertical travel of the floating portion is limited by a housing protrusion disposed between the front and rear towers, the housing protrusion extending away from the housing toward the floating portion.

14. The connector assembly of claim 8, wherein the latch comprises a front latch finger that engages the front tower to prevent the latch from moving toward the rear tower.

15. A connector assembly configured to latch and unlatch with a mating connector having a latch cavity, the connector assembly comprising:

a housing comprising a front tower and a rear tower; and a latch coupled to the housing and supported by the front and rear towers, the latch comprising a latch end and a floating portion, the latch end configured to be inserted into the latch cavity to latch with the mating connector and removed from the latch cavity to unlatch with the mating connector, the floating portion disposed between the front and rear towers, wherein the front tower extends above the housing by a tower height, the tower height being sufficiently small such that a load applied to the floating portion toward the housing and between the front and rear towers elastically deforms the latch in order to raise the latch end out from the latch cavity.

16. The connector assembly of claim 15, wherein the front and rear towers are spaced sufficiently close together such that the load causes the latch end to be raised from the latch cavity.

17. The connector assembly of claim 15, wherein the front and rear towers are spaced sufficiently far apart such that the load raises the latch end out of the latch cavity without plastically deforming the latch.

18. The connector assembly of claim 15, wherein a vertical travel of the floating portion is limited by a housing protrusion disposed between the front and rear towers and extending away from the housing toward the floating portion.

19. The connector assembly of claim 15, wherein the latch comprises a front latch finger that engages the front tower to prevent the latch from moving toward the rear tower.

20. The connector assembly of claim 15, wherein the tower height is sufficiently tall such that the load causes the latch end to be completely raised from the latch cavity.

* * * * *